US005300734A

United States Patent [19]

Suzuki

[11] Patent Number: 5,300,734

[45] Date of Patent: Apr. 5, 1994

[54] GROMMET

[75] Inventor: Motoyoshi Suzuki, Shizuoka, Japan

[73] Assignee: Yazaki Corporation, Japan

[21] Appl. No.: 935,433

[22] Filed: Aug. 26, 1992

[30] Foreign Application Priority Data

Sep. 2, 1991 [JP] Japan ..... 3-070029[U]

[51] Int. Cl.[5] ..... H01R 13/56

[52] U.S. Cl. ..... 174/152 G; 174/135; 174/65 R; 439/271; 439/278; 439/281; 439/125; 439/445; 439/901

[58] Field of Search ..... 174/152 G, 135, 65 R; 439/271, 272, 273, 278, 281, 125, 127, 128, 282, 445, 901

[56] References Cited

U.S. PATENT DOCUMENTS

| | | | |
|---|---|---|---|
| 1,282,468 | 7/1917 | Scheel | 439/445 X |
| 2,119,452 | 5/1938 | Woodhead | 439/271 |
| 2,567,727 | 9/1951 | Quackenbush | 439/278 X |
| 3,609,214 | 9/1971 | Totsuka | 174/65 R |
| 3,792,415 | 2/1974 | Fuller | 439/272 X |
| 4,713,015 | 12/1987 | Takiguchi | 439/278 |
| 5,018,987 | 5/1991 | Kirma | 439/445 |

FOREIGN PATENT DOCUMENTS

| | | | |
|---|---|---|---|
| 3927128 | 11/1990 | Fed. Rep. of Germany | 439/272 |
| 55-44317 | 10/1980 | Japan . | |
| 62-102289 | 6/1987 | Japan . | |
| 0955633 | 4/1964 | United Kingdom | 439/445 |

*Primary Examiner*—Leo P. Picard
*Assistant Examiner*—H. Sough
*Attorney, Agent, or Firm*—Wigman, Cohen, Leitner & Myers

[57] ABSTRACT

A grommet which is coupled with a connector and covers a wire which is connected to the connector so as to protect the wire is disclosed. The grommet is comprised of a coupling end having flexibility and being coupled with the connector, a tube-like end having an open end into which the wire is inserted prior to being connected to the connector, a hollow intermediate having flexibility and being provided between and connected with the coupling end and the tube-like end so as to contain the wire, and a handling member made of a hard material and arranged around the coupling end so as to be held in one's fingers.

8 Claims, 3 Drawing Sheets

GROMMET

BACKGROUND OF THE INVENTION

The present invention relates to a grommet for a connector used for arranging wires in, for example, an automobile.

In order to arrange wires between two positions in which one moves relatively around the other such as a door and a body of an automobile, an elastic or flexible tube-like grommet is prepared so as to be coupled with a connector provided for wiring, thereby protecting wires arranged inside the grommet. This type of grommet is disclosed in Japanese Utility Model Publication 55-44317.

FIG. 1 is an elevational view of the conventional grommet for protecting wires as described above, and FIG. 2 is a perspective view showing an arrangement of the grommet, wires, and a connector just before the grommet is coupled with the connector. The grommet 1 includes a coupling end 2 which is rectangularly shaped corresponding approximately to a shape of a connector which is to be coupled with the grommet 1, a hollow intermediate 3, and a tube-like end 4 from which the wires are inserted. The coupling end 2 and the tube-like end 4 are connected with each other by the hollow intermediate 3, whereby the grommet 1 has a tube-like shape. Further, the entire grommet 1 may be unitarily molded into one piece of a flexible rubber material which has a uniform thickness. Prior to coupling the grommet 1 with a connector 5, a group of terminals 20 provided on one end of each of the wires 6 are inserted into the grommet 1 from the tube-like end 4. While the grommet 1 is grasped in a hand, each of the terminals 20 is inserted into terminal holes 21 for connecting, respectively. Next, the grommet 1 is coupled with the connector 5 through the coupling end 2. Further, the tube-like end 4 and the wires 6 are banded together with a roll of tape so that the tube-like end 4 is fixedly mounted on the wires 6. If the connector 5 is a male type connector, the connector 5 may be fitted in a female type connector as a final step for arranging the wires. In this way, the grommet 1 serves as a protector for the wires 6. Namely, the flexibility or elasticity of the grommet 1 is very advantageous when used with wires 6 which are arranged between two positions one of which moves relatively around the other in such a way that the wires 6 are bent or stretched.

On the other hand, due to the flexibility or elasticity of the grommet 1 which is unitarily molded into one piece of a elastic material such as rubber material, the grommet 1 may be stretched, bent, or twisted, while being held in one's fingers in order to execute coupling with the connector 5, thereby causing difficulty in coupling therewith. Fitting a connector inside the grommet 1 so as to accomplish a complete coupling may be especially difficult.

SUMMARY OF THE INVENTION

In view of the above, an object of the present invention is to solve the aforementioned problem in the prior art through the introduction of a grommet which has flexibility or elasticity and can be coupled with a connector very easily even so as to execute said coupling completely.

The aforesaid object of the present invention is accomplished through a grommet which is coupled with an end of a connector and covers a part of a wire which is connected to said connector so as to protect the wire, the grommet comprising; a coupling end having flexibility and being coupled with said connector; a tube-like end having an open end into which said wire is inserted prior to being connected to said connector; a hollow intermediate having flexibility and provided between said coupling end and said tube-like end so as to contain said wire; and a handling member made of a hard material and arranged around said coupling end.

In the above-described grommet according to the present invention, since said handling member is made of a hard material, it can be held in one's fingers very easily. In this way, coupling the grommet with a connector can be carried out very easily. Further, even fitting a connector inside the grommet so as to accomplish complete coupling thereof can be completed very easily.

DETAILED DESCRIPTION OF THE PREFERRED EMBODIMENTS

Figure 1:
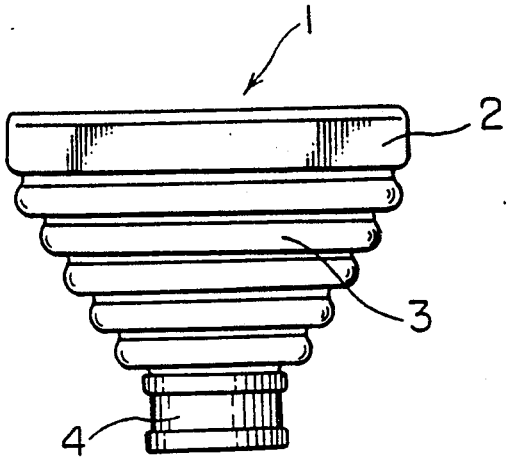
FIG.1 PRIOR ART
FIG. 1 is an elevational view of a grommet according to a conventional example.
Figure 2:
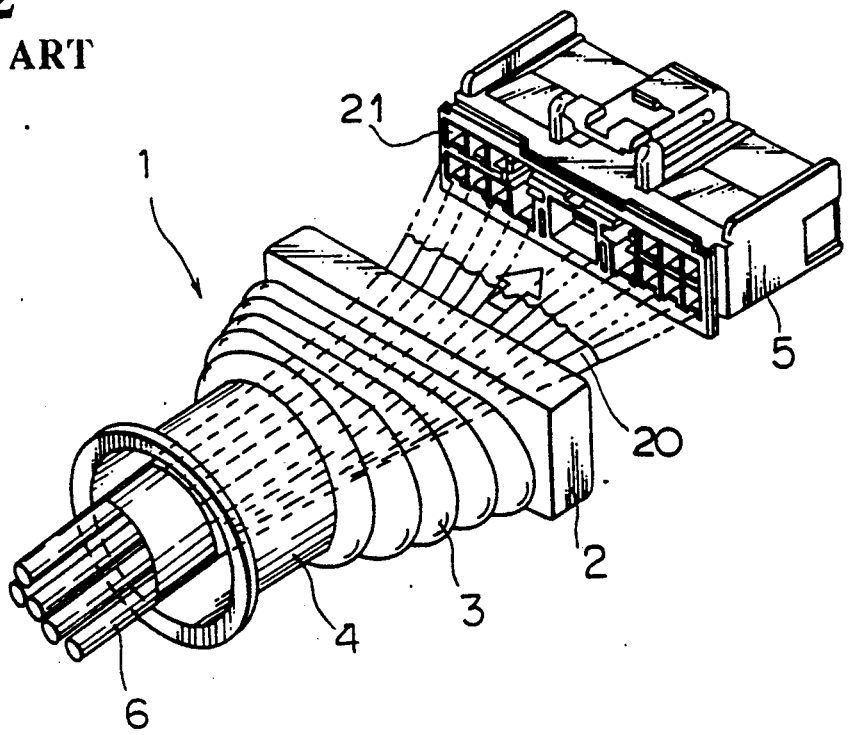
FIG.2 PRIOR ART
FIG. 2 is an explanatory perspective view showing an arrangement of the grommet illustrated in FIG. 1, with wires, just before the grommet is coupled with a connector.
Figure 3:
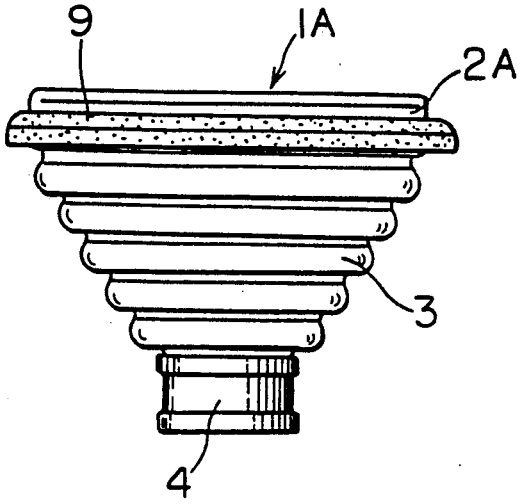
FIG. 3 is an elevational view of a grommet according to the present invention.

An embodiment according to the present invention will be described hereinafter using FIGS. 3~5.

First, a structure of a grommet 1A according to the present invention will be described. In the grommet 1A, a coupling end 2A, a hollow intermediate 3, and a tube-like end 4 comprise a unitary structure molded into one piece of a flexible elastic material, namely a rubber material. The hollow intermediate 3 has gathers or bellows. The coupling end 2A is formed into a shape having a rectangular hole 13 which corresponds approximately to a shape of a coupling housing of a connector 5. A handling member (a supporting member) 9, which may be made of a relatively hard material, for example a resin (a plastic such as polyethylene, polyvinyl chloride, etc.), is formed into a rectangular frame shape, for example, by injection molding. Further, this handling member 9 is fixedly mounted on the coupling end 2A. Namely, the coupling end 2A has a groove 10 on the outside periphery thereof, and the handling member 9 is fitted in and joined with the groove 10. It does not matter whether forming and mounting of the handling member 9 is executed while the unitary structure of the coupling end 2A, the hollow intermediate 3, and the tube-like end 4 are formed. It is possible to employ a type of glue in order to join the handling member 9 to the coupling end 2A after the other structure are formed.

Figure 5:
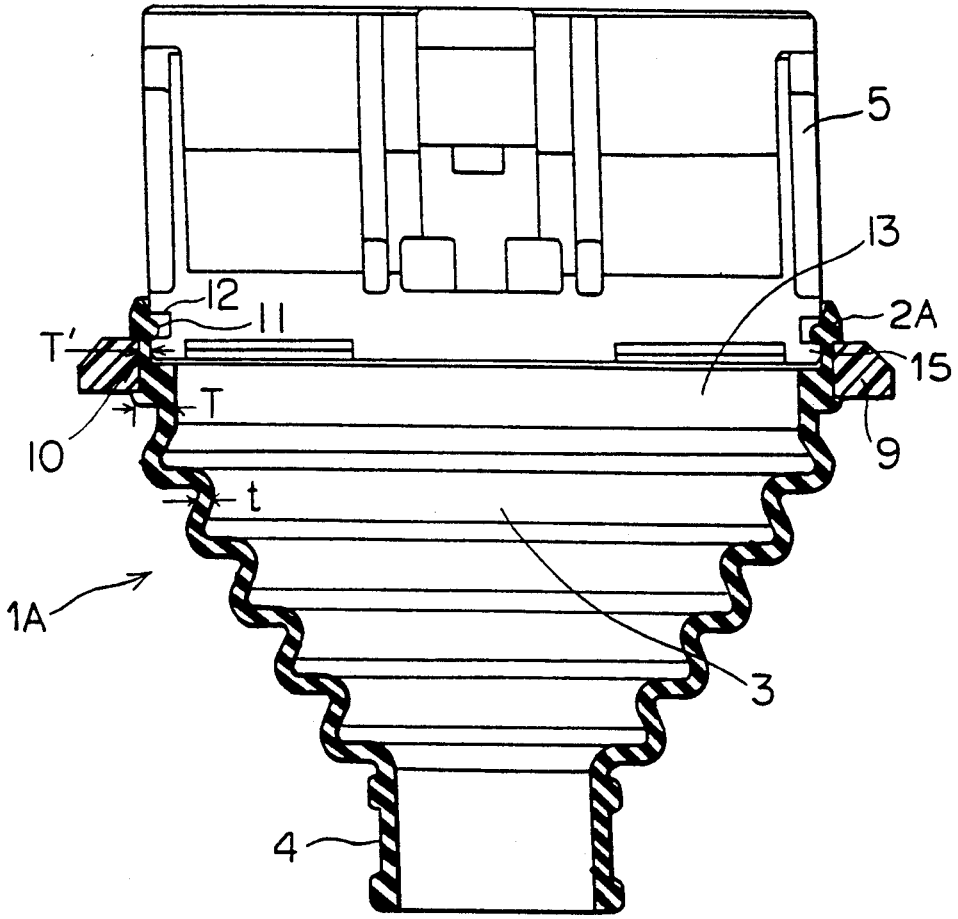
FIG. 5 is a cross sectional view of the grommet illustrated in FIGS. 3 and 4.

In this embodiment, as shown in FIG. 5, the coupling end 2A comprises a first portion whose thickness T is relatively thicker than that of another part, for example, thickness t of the hollow intermediate 3, thereby ensuring a certain level of strength of the first portion for the above-mentioned mounting work. This first portion is located close to the hollow intermediate 3 (located in an inner side of the grommet 1A) and is abutted against the groove 10. Further, the coupling end 2A comprises a second portion whose thickness T' is relatively thinner than said thickness T. This second portion is located close to the open end of the coupling end 2A and is abutted against the groove 10, thereby facilitating coupling work of the grommet 1A with the connector 5.

Moreover, the coupling end 2A has a protruding portion 11 which protrudes from the inside periphery, close to the groove 10 and closer to the open end of the coupling end 2A than the second portion having thickness T'. In this way, the protruding portion 11 can be fitted in a housing groove 12 which is provided on the outside periphery of the connector 5 in order to prevent the coupling end 2A from falling out of the connector 5. The protruding portion 11 may have a ring-like shape whose cross section is a semicircle.

Next, the actions and effects thereof in the present embodiment will be described.

Figure 4:
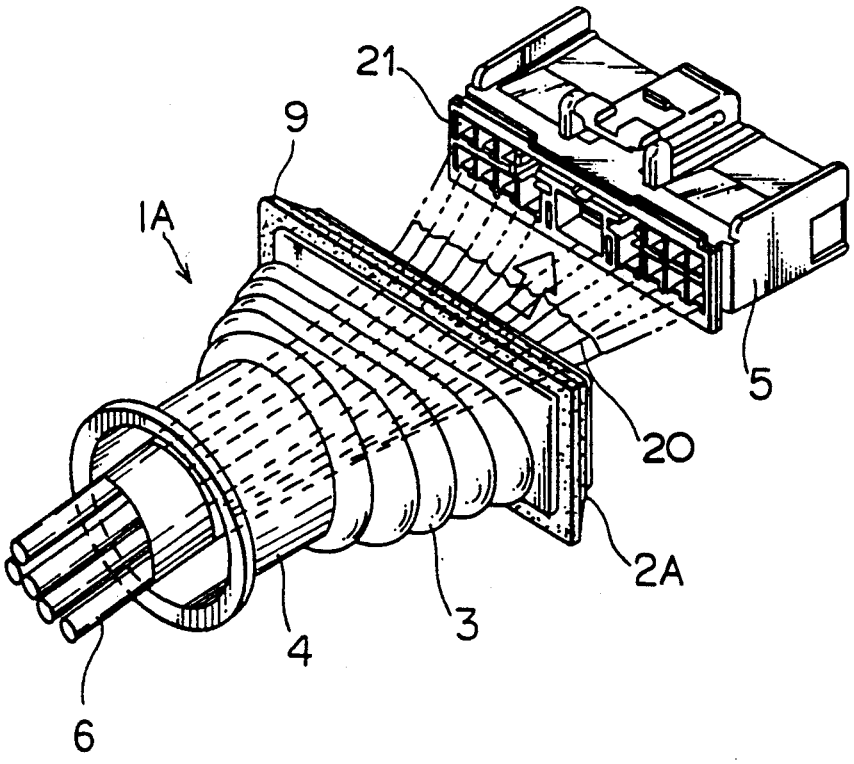
FIG. 4 is an explanatory perspective view showing an arrangement of the grommet illustrated in FIG. 3, with wires, just before the grommet is coupled with a connector.

Prior to coupling the grommet 1A with the connector 5, as shown in FIG. 4, while both longitudinal sides or both vertical sides of the handling member 9 of the grommet 1A are held in a hand, a group of terminals 20 provided on one side end (the right hand in FIG. 4) of each of the wires 6 are inserted into the grommet 1A from the open end of the tube-like end 4 followed by insertion into terminal holes 21 for connecting, respectively. Then, the connector 5, while being held in the other hand, is coupled with the grommet 1A in a direction depicted by an arrow in FIG. 4. During this process, since the handling member 9 is made of a hard material (i.e. it is hard, or rigid), it may be held or grasped tightly, thereby facilitating the coupling process. Namely, the coupling process is not disturbed by stretching, shrinking, or twisting of the hollow intermediate 3. Furthermore, at the time of coupling, the entire coupling end 2A including the protruding portion 11 is transformed elastically so as to be enlarged outwardly. In this way, the protruding portion 11 enters (i.e. the protruding portion is fitted in) the housing groove 12 so as to ensure that the grommet 1A does not fall out of the connector 5. Moreover, the second portion with thickness T' in the coupling end 2A allows a housing end portion 15 of the connector 5 to be fitted therein easily. After the above-described coupling takes place, the tube-like end 4 and the wires 6 are banded together with a roll of tape so that the tube-like end 4 is fixedly mounted on the wires 6. Then if the connector 5 is one of a pair of connectors, it may be connected with the other connector as a final step for arranging the wires. Furthermore, the grommet 1A including the handling member 9 facilitates the connection of the pair of connectors mentioned above since the handling member 9 can be held tightly in one's fingers.

In the grommet 1A according to the present embodiment, since the rigid handling member 9 is limitedly provided on the coupling end 2A, the flexibility and elasticity of the entire grommet 1A itself remains at a satisfactory level. Specifically, since the hollow intermediate 3 has gathers or bellows, that is, the hollow intermediate 3 is flexible, the entire grommet 1A demonstrates sufficient flexibility.

In connection with the above-described embodiment, a handling member should not be limited to the handling member 9 which is in an exposed condition. Namely, the handling member 9 may be buried in the coupling end 2A which is made of a rubber material, thereby exhibiting similar merits as the above described handling member 9.

What is claimed is:

1. A grommet which is coupled with an end of a connector and coves a wire which is connected to said connector so as to protect said wire, said grommet comprising:

a coupling end having flexibility and being coupled with said connector end, said coupling end having a protruding portion protruding inwardly from an inner periphery of the coupling end to be fitted in a housing groove provided in an outer periphery of the connector end;

a tube-like end having an open end into which said wire is inserted prior to being connected to said connector;

a hollow intermediate having flexibility and being provided between said coupling end and said tube-like end so as to contain said wire;

and a handling member formed on a hard material and arranged around said coupling end, said coupling end including a first portion abutting against an end face in the end portion of the connector, a second portion, and a second groove bounded by said first portion and said second portion into which the handling member is fixedly mounted.

2. The grommet as set forth in claim 1, wherein said coupling end, hollow intermediate, tube-like end comprises a unitary structure molded into one piece of a flexible elastic material.

3. The grommet according to claim 1, wherein handling member is fully encapsulated in said coupling end.

4. A grommet which is coupled with an end of a connector and covers a wire which is connected to said connector so as to protect said wire, said grommet comprising:

a coupling end having flexibility and being coupled with said connector end, said coupling end having a protruding portion protruding inwardly from an inner periphery of the coupling end to be fitted in a housing groove provided in an outer periphery of the connector end;

a tube-like end having an open end into which said wire is inserted prior to being connected to said connector;

a hollow intermediate having flexibility and being provided between said coupling end and said tube-like end so as to contain said wire;

and a handling member formed of a hard material and arranged around said coupling end, wherein the coupling end further includes a first portion having a wall thickness greater than a wall thickness of said hollow intermediate, said first portion being located adjacent to the hollow intermediate and abutting against an end face in the end portion of the connector, a second portion having a wall thickness less than the wall thickness of said first portion, said second portion located between said protruding portion and said first portion, and wherein said first and second portions and said protruding portion define a second groove, said second groove bounded by the housing groove and the endmost portion thereof into which the connector protruding portion is fitted.

5. The grommet according to claim 4, wherein said coupling end includes a securing groove formed at the outer periphery thereof for receiving said handling member.

6. The grommet according to claim 5, wherein said protruding portion is adapted to easily pass over the connector protruding portion when the grommet is coupled to the end of the connector.

7. The grommet according to claim 6, wherein said protruding portion includes a curvilinear face.

8. The grommet according to claim 6, wherein said protruding portion includes a substantially semi-circular face.

* * * * *